US009863638B2

(12) United States Patent
Donovan

(10) Patent No.: US 9,863,638 B2
(45) Date of Patent: Jan. 9, 2018

(54) AIR SHROUDS WITH IMPROVED AIR WIPING

(71) Applicant: Delavan Inc, West Des Moines, IA (US)

(72) Inventor: Matthew R. Donovan, Ankeny, IA (US)

(73) Assignee: Delavan Inc., West Des Moines, IA (US)

( * ) Notice: Subject to any disclaimer, the term of this patent is extended or adjusted under 35 U.S.C. 154(b) by 343 days.

(21) Appl. No.: 14/675,912

(22) Filed: Apr. 1, 2015

(65) Prior Publication Data

US 2016/0290651 A1 Oct. 6, 2016

(51) Int. Cl.

| | |
|---|---|
| ***F23R 3/34*** | (2006.01) |
| ***F23R 3/28*** | (2006.01) |
| ***F23D 11/10*** | (2006.01) |
| ***F23D 11/38*** | (2006.01) |

(52) U.S. Cl.

CPC ..... *F23R 3/286* (2013.01); *F23D 11/107* (2013.01); *F23D 11/383* (2013.01); *F23R 3/34* (2013.01)

(58) Field of Classification Search

CPC ..... F23R 3/286; F23R 3/304; F23D 11/107; F23D 11/38; F23D 11/383

See application file for complete search history.

(56) References Cited

U.S. PATENT DOCUMENTS

| | | | | | |
|---|---|---|---|---|---|
| 2,539,315 | A * | 1/1951 | Murphy | F23D 11/107 | 239/404 |
| 3,937,011 | A * | 2/1976 | Caruel | F23D 11/107 | 239/404 |
| 4,139,157 | A * | 2/1979 | Simmons | F23D 11/107 | 239/400 |
| 4,170,108 | A * | 10/1979 | Mobsby | F23R 3/28 | 239/400 |
| 4,356,970 | A * | 11/1982 | Vosper | B05B 1/14 | 239/290 |
| 4,946,105 | A * | 8/1990 | Pane, Jr. | B05B 7/065 | 239/398 |
| 5,044,559 | A * | 9/1991 | Russell | F23D 11/107 | 239/406 |
| 5,115,634 | A * | 5/1992 | Bretz | B05B 7/066 | 60/778 |

(Continued)

OTHER PUBLICATIONS

Extended European Search Report dated Jul. 27, 2016, issued on corresponding European Patent Application No. 16163568.5.

*Primary Examiner* — Pascal M Bui Pho
*Assistant Examiner* — Eric Linderman
(74) *Attorney, Agent, or Firm* — Locke Lord LLP; Daniel J. Fiorello; Joshua L. Jones

(57) ABSTRACT

An air shroud for a nozzle includes an air shroud body defining an inlet and an outlet in fluid communication with one another to allow an outer airflow to issue therefrom, the air shroud body defining a downstream surface. A plurality of air wipe channels are defined within the air shroud body, wherein each of the plurality of air wipe channels is in fluid communication with at least one of a plurality of air wipe outlets and air wipe inlets. Each air wipe outlet is defined in the downstream surface of the air shroud body such that air can flow through each air wipe outlet and wipe the downstream surface of the air shroud body.

18 Claims, 4 Drawing Sheets

(56) References Cited

U.S. PATENT DOCUMENTS 5,277,023 A * 1/1994 Bradley ..... F02B 77/04 239/119
6,247,317 B1 * 6/2001 Kostka ..... F23C 7/002 60/741
6,301,900 B1 * 10/2001 Mandai ..... F23D 11/107 60/740
6,622,488 B2 * 9/2003 Mansour ..... F23D 11/107 239/403
6,892,962 B2 * 5/2005 Hurley ..... B05B 1/14 239/403
7,464,553 B2 * 12/2008 Hsieh ..... F23R 3/14 60/740
8,146,365 B2 * 4/2012 Shum ..... F23D 11/108 60/740
2003/0141383 A1 * 7/2003 Hayashi ..... F23C 7/004 239/406
2004/0061001 A1 * 4/2004 Mao ..... B05B 7/08 239/398
2005/0097889 A1 * 5/2005 Pilatis ..... F23D 11/107 60/743
2005/0217270 A1 * 10/2005 Sampath ..... F02C 7/222 60/740
2007/0028618 A1 * 2/2007 Hsiao ..... F23R 3/14 60/737
2009/0217669 A1 * 9/2009 Young ..... F23D 11/107 60/737
2009/0277176 A1 * 11/2009 Caples ..... F02C 7/222 60/737
2010/0251720 A1 * 10/2010 Pelletier ..... F23D 11/107 60/740
2013/0086949 A1 * 4/2013 Charbonneau ..... F23D 14/64 65/134.4
2014/0166143 A1 * 6/2014 Buelow ..... F23R 3/28 138/109
2014/0245742 A1 * 9/2014 Chew ..... F23R 3/14 60/748
2015/0047361 A1 * 2/2015 Williams ..... F23R 3/343 60/746
2015/0069148 A1 * 3/2015 Ryon ..... F23R 3/283 239/397.5
2015/0211740 A1 * 7/2015 Kim ..... F23R 3/14 60/748
2015/0285501 A1 * 10/2015 DiCintio ..... F23R 3/14 60/740
2016/0010855 A1 * 1/2016 Myers ..... F23D 11/24 239/403
2016/0230997 A1 * 8/2016 Donovan ..... F23R 3/14
2016/0237911 A1 * 8/2016 Chabaille ..... F23R 3/343
2016/0238255 A1 * 8/2016 Ryon ..... B05B 7/10

* cited by examiner

AIR SHROUDS WITH IMPROVED AIR WIPING

BACKGROUND

1. Field

The present disclosure relates to air shrouds for nozzles, more specifically to air shrouds for fuel nozzles such as in gas turbine engine fuel injectors.

2. Description of Related Art

Fuel nozzles allow for mixing of fuel and air for injection into a combustor. Due to the turbulent nature of the flow-field, some of the liquid fuel spray from the fuel nozzle will wet the metal surfaces of the fuel nozzle which are exposed to the hot combustion gases. If the fuel temperature on the surface of the metal is in the proper range (about 200° C. to about 400° C. for jet fuel), then fuel will chemically break down to form carbon deposits on the metal surfaces. This can occur on the exposed surfaces of fuel pre-filmers and/or air-caps (also called air-shrouds). Carbon-formation on these metal surfaces is undesirable because this can adversely affect spray and combustion performance. Also, this carbon can sometimes break free from the metal surface and flow downstream where it can come into contact with the turbine and cause turbine erosion, which shortens the life of the turbine. In other cases, the exposed metal surfaces of the fuel nozzle (most commonly the air-shrouds) are subject to excessive heating from the combustion gases, which can result in thermal erosion or cracking of the metal.

A common method to alleviate either the problem of carbon-formation or thermal-erosion is to add an additional (smaller) air-shroud outboard of the existing air-shroud. This smaller air-shroud is commonly called an air-wipe and serves the function of directing compressor-discharge air downward over the face of the first (larger) air-shroud to either preferentially prevent carbon-formation or alleviate thermal-erosion. In some cases, these air-wipes also experience thermal-erosion and require some method to manage the thermal load. Typically, a series of small holes through the air-wipe are added to provide additional cooler compressor-discharge air in order to reduce the thermal load. Often this will alleviate the problem, but not always. In some cases, it is difficult to get a sufficient amount of additional compressor-discharge air in the vicinity of the air-wipe. In other cases, the thermal loading results in differential thermal expansion of the air-wipe which can result in cracking and reduced life of the fuel nozzle, or possible wear on the turbine due to the air-wipe liberating from the fuel nozzle and traveling downstream through the turbine. Therefore, there is still a need in the art for improved systems to wipe the downstream surface of an air shroud and/or nozzle. The present disclosure provides a solution for this need.

SUMMARY

An air shroud for a nozzle includes an air shroud body defining an inlet and an outlet in fluid communication with one another to allow an outer airflow to issue therefrom, the air shroud body defining a downstream surface. A plurality of air wipe channels are defined within the air shroud body, wherein each of the plurality of air wipe channels is in fluid communication with at least one of a plurality of air wipe outlets and air wipe inlets. Each air wipe outlet is defined in the downstream surface of the air shroud body such that air can flow through each air wipe outlet and wipe the downstream surface of the air shroud body.

At least one of the air wipe channels can be straight between the air wipe inlet and the air wipe outlet. In certain embodiments, at least one of the air wipe channels can be defined non-linearly (e.g., such that the flow can deviate from a straight path) between the air wipe inlet and the air wipe outlet. For example, at least one of the air wipe channels can be spiraled around a central axis of the air shroud body.

The air wipe outlets can open in a direction to direct air normally toward a central axis of the air shroud body. In certain embodiments, the air wipe outlets can open in a direction to direct air tangentially relative to a central axis of the air shroud body to swirl airflow about a central axis of the air shroud body.

The air wipe inlets can be defined on an inner surface of the air shroud body. In certain embodiments, the air wipe inlets can be defined on an upstream surface of the air shroud body such that the air wipe channel is defined along the entire length of the air shroud body.

The downstream surface of the air shroud body can be axially angled. For example, the downstream surface of the air shroud body can be conical.

A fuel nozzle includes a nozzle body defining a fuel circuit connecting a fuel inlet to a fuel outlet and including a prefilmer disposed in fluid communication with the fuel outlet, and an air shroud as described above disposed outboard of the prefilmer to direct air toward fuel issued from the nozzle body.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
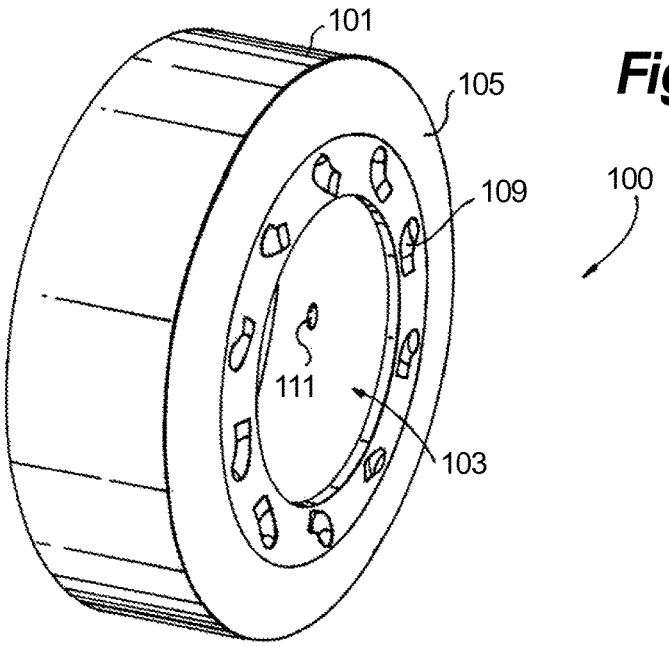
FIG. 1A is a perspective view of an embodiment of an air shroud in accordance with this disclosure, shown having air wipe outlets disposed on a downstream surface of the air shroud body.

Reference will now be made to the drawings wherein like reference numerals identify similar structural features or aspects of the subject disclosure. For purposes of explanation and illustration, and not limitation, an illustrative view of an embodiment of an air shroud in accordance with the disclosure is shown in FIG. 1A and is designated generally by reference character 100. Other embodiments and/or aspects of this disclosure are shown in FIGS. 1B-4B. The systems and methods described herein can be used to prevent or reduce carbon buildup on air shroud components, as well as reduce excessive thermal loading on the air shroud components in order to extend the life of the components. The systems and methods described herein can also be used to improve the structural integrity of the air-shroud components for extending the life of the components.

Figure 1B:
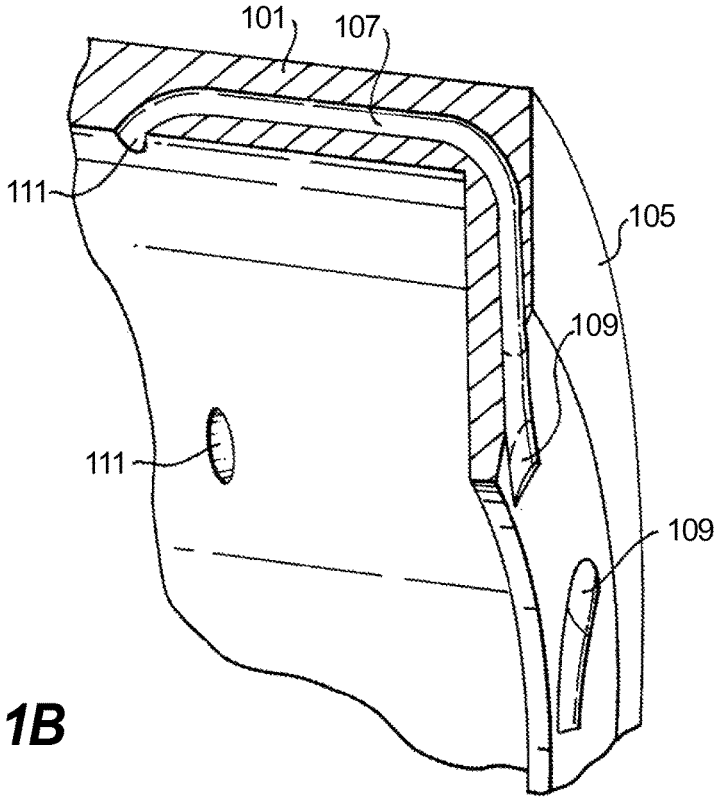
FIG. 1B is partial cross-sectional view of the air shroud of FIG. 1A, showing an air wipe channel defined in the air shroud body extending from an air wipe inlet to the air wipe outlet.

Referring to FIGS. 1A and 1B, an air shroud 100 for a nozzle (e.g., fuel nozzle 400 as shown in FIG. 4) includes an air shroud body 101 defining a central mixing outlet 103 to allow a fuel-air mixture to be outlet therefrom. The air shroud body 101 has a downstream surface 105 facing the downstream direction relative to a flow through the air shroud 100.

The downstream surface 105 of the air shroud body 101 can be axially angled in the downstream direction. For example, the downstream surface 105 of the air shroud body 101 can be conical (e.g., a chamfered truncated cone shape). This is also contemplated that the downstream surface 105 can have any other suitable profile.

Referring to FIG. 1B, a plurality of air wipe channels 107 are defined within the air shroud body 101. Each of the plurality of air wipe channels 107 is in fluid communication with at least one of a plurality of air wipe outlets 109 and air wipe inlets 111. Each air wipe outlet 109 is defined in the downstream surface 105 of the air shroud body 101 such that air can flow through each air wipe outlet 109 and wipe the downstream surface 105 of the air shroud body 101.

Figure 3:
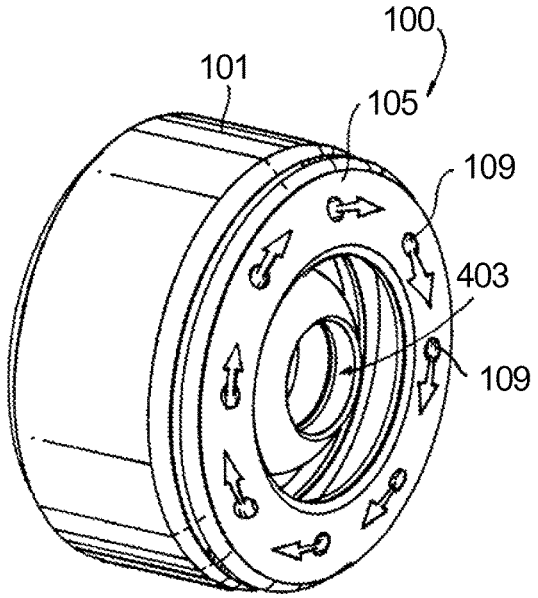
FIG. 3 is a perspective view of an embodiment of an air shroud in accordance with this disclosure, shown disposed on a fuel nozzle.

The air wipe outlets 109 can be defined and/or open in a direction to direct air normally toward a central axis of the air shroud body 101. In certain embodiments, as shown in FIGS. 1A and 3, the air wipe outlets 109 can be defined and/or open in a direction to direct air tangentially relative to a central axis of the air shroud body 101 to swirl airflow about a central axis of the air shroud body 101. As shown, air wipe outlets 111 can curve and expand at or close to the downstream surface 105. However, it is contemplated that the air wipe outlets 111 can have a constant flow area or any other suitable changing flow area/direction (e.g., contracting).

As shown in FIGS. 1A and 1B, the air wipe inlets 111 can be defined on an inner surface of the air shroud body 101. Referring to FIG. 2C, in certain embodiments, one or more of the air wipe inlets 211 can be defined on an upstream surface of the air shroud body 201 such that the air wipe channel 207 is defined along the entire length of the air shroud body 201. Disposing the air wipe inlets 211 on the inlet side can provide better pressure differential and flow speed.

Referring to FIGS. 1A and 1B, at least one of the air wipe channels 107 can be straight (i.e., linear) between the air wipe inlet 111 and the air wipe outlet 109. In certain embodiments, referring to FIGS. 2A, 2B, and 2C, at least one of the air wipe channels 207 of air shroud 200 can be defined non-linearly (e.g., such that flow deviated from a straight path) between the air wipe inlet 211 and the air wipe outlet 209. For example, at least one of the air wipe channels 207 can be spiraled around a central axis defined through a central mixing outlet 203 of the air shroud body 201.

Figure 2A:
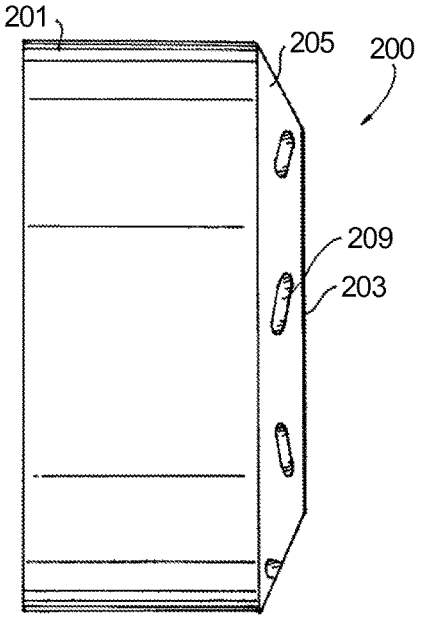
FIG. 2A is a side elevation view of an embodiment of an air shroud in accordance with this disclosure, showing axial air outlets disposed in the air wipe.
Figure 2B:
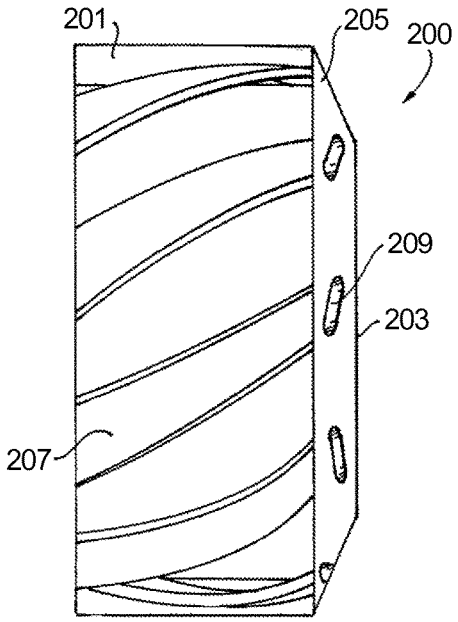
FIG. 2B is a side elevation view of the air shroud of FIG. 2A, showing the air wipe channel flow space as defined within the air wipe body.
Figure 2C:
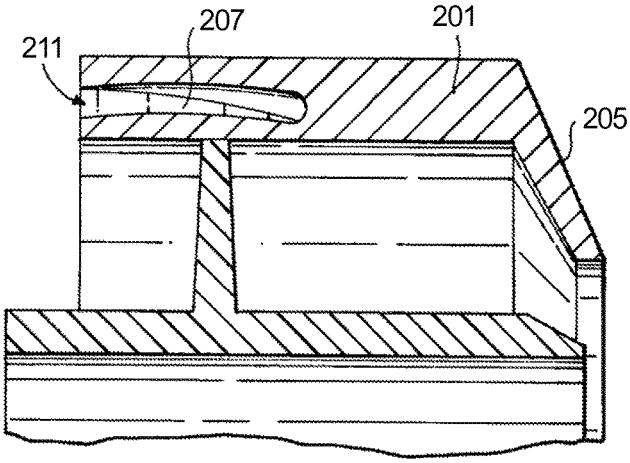
FIG. 2C is a partial cross-sectional view of a portion of the air shroud of FIG. 2A, an air wipe inlet in fluid communication with an upstream side of the air wipe body.

Referring to FIG. 2B, the air wipe channels 207 can include a non-constant cross-sectional area. As shown, the air wipe channels 207 can contract in area in the direction of flow, e.g., to increase flow speed at the air wipe outlets 209. Any other suitable channel cross-sectional area can be used as appropriate for a given application (e.g., constant or expanding).

It is contemplated that air shrouds 100, 200 can be manufactured using suitable additive manufacturing techniques or any other suitable manufacturing technique (e.g., casting). Additive manufacturing can allow for complex shaped passages that cannot be formed using traditional manufacturing techniques (e.g., such that the channels can catch airflow from any suitable portion upstream and direct it in any suitable direction downstream).

Referring to FIG. 3, the shroud 100 is shown with flow arrows of wiping airflow issuing from the air wipe outlets 109. As shown, the air wipe outlets 109 are angled to issue wiping airflow in an at least partially tangential direction to create a swirling flow.

Figure 4A:
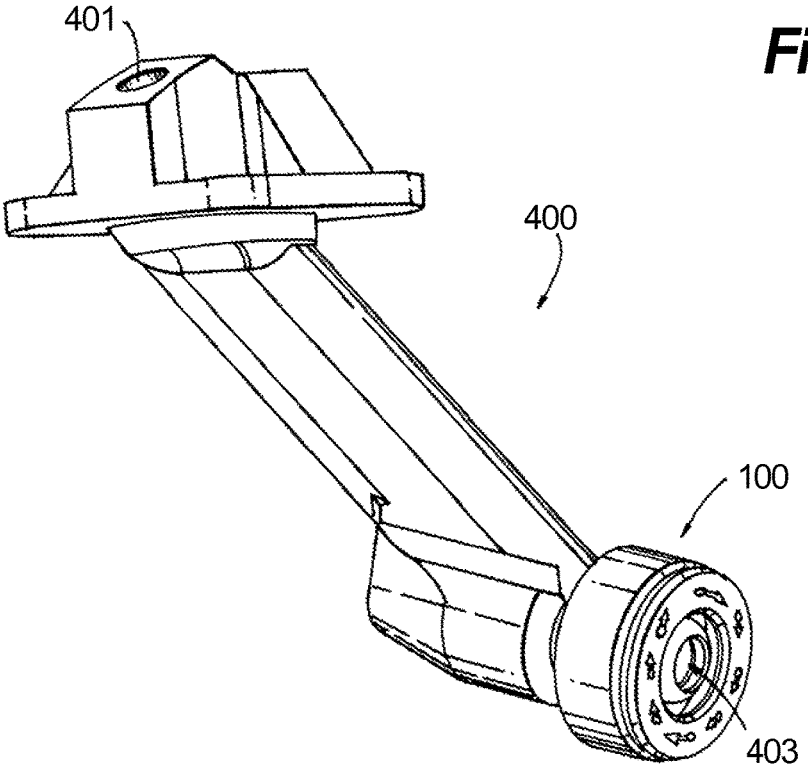
FIG. 4A is a perspective view of an injector in accordance with this disclosure, showing an embodiment of an air shroud disposed thereon.
Figure 4B:
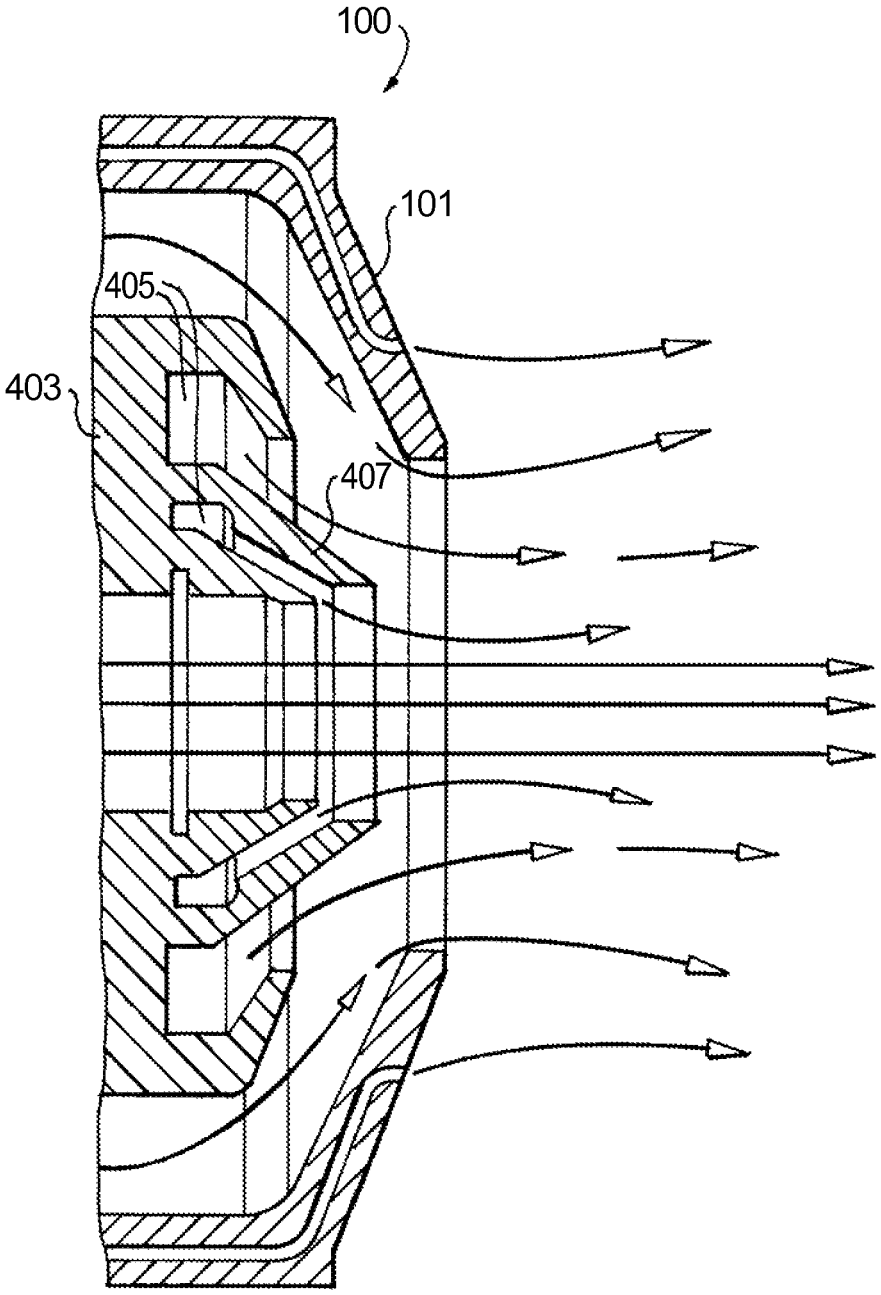
FIG. 4B is a cross-sectional side view of the injector shown in FIG. 4A, showing flow therethrough.

Referring to FIGS. 4A and 4B, a fuel nozzle 400 includes a fuel inlet 401, a fuel outlet 403 in fluid communication with the fuel inlet 401 to inject fuel into a combustion chamber, and a fuel circuit 405 connecting the fuel inlet 401 to the fuel outlet 403. The fuel circuit 405 can include a prefilmer 407 disposed in fluid communication with the fuel outlet 403. The fuel nozzle 400 can include an air shroud as described above (e.g., air shroud 100 as shown) as described above disposed outboard of the prefilmer 407 to mix air with fuel ejecting from the fuel nozzle 400.

As described above, the air wipe 107 provides a wiping airflow that, under some conditions, helps remove fuel off of the downstream surface 105 of the air shroud body 101. Under other conditions (e.g., excessive heat load), the airflow also prevents further thermal erosion of the downstream surface 105. Finally, the web of material 109 between the air wipe passages/outlets 111 provide improved structural support to the air wipe 107. These features can increase the useable lifespan of the assembly and/or the time between required maintenance.

The methods and systems of the present disclosure, as described above and shown in the drawings, provide for air shrouds with superior properties including enhanced wiping for reducing carbon buildup and/or improved thermal management. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. An air shroud for a nozzle, comprising:

a cylindrical air shroud body defining an inlet and a central mixing outlet in fluid communication with one another to allow an airflow to issue from the central mixing outlet, the cylindrical air shroud body defining a downstream exterior surface and an upstream interior surface, wherein the cylindrical air shroud body defines a cavity configured to surround the nozzle, the central mixing outlet located in the downstream exterior surface; and a plurality of air wipe channels defined within the cylindrical air shroud body, wherein each of the plurality of air wipe channels is in fluid communication with at least one of a plurality of air wipe outlets and air wipe inlets, wherein each air wipe inlet is defined in the upstream interior surface of the cylindrical air shroud body, wherein each air wipe outlet is defined in the downstream exterior surface of the air shroud body such that air can flow through each air wipe outlet and wipe the downstream exterior surface of the air shroud body, wherein at least one of the plurality of air wipe channels is spiraled around a central axis of the cylindrical air shroud body in at least a portion of the air wipe channel between the at least one of said plurality of air wipe outlets and air wipe inlets.

2. The air shroud of claim 1, wherein at least one of the plurality of the air wipe channels is straight between the at least one of said plurality of air wipe outlets and air wipe inlets.

3. The air shroud of claim 1, wherein at least one of the plurality of air wipe channels is defined non-lineraly between the at least one of said plurality of air wipe outlets and air wipe inlets.

4. The air shroud of claim 1, wherein the at least one of said plurality of air wipe outlets are defined to direct air normally toward a central axis of the cylindrical air shroud body.

5. The air shroud of claim 1, wherein the at least one of said plurality of air wipe outlets are defined to direct air tangentially relative to a central axis of the cylindrical air shroud body to swirl airflow about the central axis of the cylindrical air shroud body.

6. The air shroud of claim 1, wherein the at least one of said plurality of air wipe inlets is defined on the upstream interior surface of the cylindrical air shroud body.

7. The air shroud of claim 1, wherein the at least one of said plurality of air wipe inlets is defined on the upstream interior surface of the cylindrical air shroud body such that the plurality of air wipe channels is defined along the entire length of the cylindrical air shroud body.

8. The air shroud of claim 1, wherein the downstream exterior surface of the cylindrical air shroud body is axially angled.

9. The air shroud of claim 1, wherein the downstream exterior surface of the cylindrical air shroud body is conical.

10. A fuel nozzle, comprising:

a nozzle body defining a fuel circuit connecting a fuel inlet to a fuel outlet and including a prefilmer disposed in fluid communication with the fuel outlet; and an air shroud disposed outboard of the prefilmer to direct air toward fuel issued from the nozzle body, the air shroud including: a cylindrical air shroud body defining an inlet and a central mixing outlet in fluid communication with one another to allow an airflow to issue from the central mixing outlet, the cylindrical air shroud body defining a downstream exterior surface and an upstream interior surface, wherein the cylindrical air shroud body defines a cavity configured to surround the nozzle, the central mixing outlet located in the downstream exterior surface; and a plurality of air wipe channels defined within the cylindrical air shroud body, wherein each of the plurality of air wipe channels is in fluid communication with at least one of a plurality of air wipe outlets and air wipe inlets, wherein each air wipe inlet is defined in the upstream interior surface of the cylindrical air shroud body, wherein each air wipe outlet is defined in the downstream exterior surface of the air shroud body such that air can flow through each air wipe outlet and wipe the downstream exterior surface of the air shroud body, wherein at least one of the air wipe channels is spiraled around a central axis of the cylindrical air shroud body in at least a portion of the air wipe channel between the at least one of said plurality of air wipe outlets and air wipe inlets.

11. The air shroud of claim 10, wherein at least one of the plurality of the air wipe channels is straight between the at least one of said plurality of air wipe outlets and air wipe inlets.

12. The air shroud of claim 10, wherein at least one of the plurality of air wipe channels is defined non-lineraly between the at least one of said plurality of air wipe outlets and air wipe inlets.

13. The air shroud of claim 10, wherein the at least one of said plurality of air wipe outlets are defined to direct air normally toward a central axis of the cylindrical air shroud body.

14. The air shroud of claim 10, wherein the at least one of said plurality of air wipe outlets are defined to direct air tangentially relative to a central axis of the cylindrical air shroud body to swirl airflow about the central axis of the cylindrical air shroud body.

15. The air shroud of claim 10, wherein the at least one of said plurality of air wipe inlets is defined on the upstream interior of the cylindrical air shroud body.

16. The air shroud of claim 10, wherein the at least one of said plurality of air wipe inlets is defined on an upstream interior surface of the cylindrical air shroud body such that the plurality of air wipe channels is defined along the entire length of the cylindrical air shroud body.

17. The air shroud of claim 10, wherein the downstream exterior surface of the cylindrical air shroud body is axially angled.

18. The air shroud of claim 1, wherein the downstream exterior surface of the cylindrical air shroud body is conical.

* * * * *